US005798475A

United States Patent [19]

Reynes et al.

[11] Patent Number: 5,798,475

[45] Date of Patent: Aug. 25, 1998

[54] SEMICONDUCTOR FUSE DEVICE AND METHOD FOR FORMING A SEMICONDUCTOR FUSE DEVICE

[75] Inventors: Jean-Michel Reynes, Pompertuzat; Jean-Francois Allier, Ramonville; Jean Caillaba, Vacquiers, all of France

[73] Assignee: Motorola, Inc., Schaumburg, Ill.

[21] Appl. No.: 681,780

[22] Filed: Jul. 29, 1996

[30] Foreign Application Priority Data

Sep. 5, 1995 [FR] France ..... 95 10374

[51] Int. Cl.[6] ..... F42B 3/13

[52] U.S. Cl. ..... 102/202.5

[58] Field of Search ..... 102/202.8, 202.7, 102/202.5, 202.4

[56] References Cited

U.S. PATENT DOCUMENTS

| | | | |
|---|---|---|---|
| 4,708,060 | 11/1987 | Bickes, Jr. et al. | 102/202.7 |
| 4,819,560 | 4/1989 | Patz et al. | 102/202.5 |
| 4,843,964 | 7/1989 | Bickes, Jr. et al. | 102/202.5 |
| 4,937,094 | 6/1990 | Doehler et al. | 427/38 |
| 4,967,665 | 11/1990 | Baginski | 102/202.2 |
| 4,976,200 | 12/1990 | Benson et al. | 102/202.7 |
| 5,085,146 | 2/1992 | Baginski | 102/202.5 |
| 5,088,329 | 2/1992 | Sahagen | 73/727 |
| 5,309,841 | 5/1994 | Hartman et al. | 102/202.4 |
| 5,371,378 | 12/1994 | Das | 257/77 |
| 5,646,050 | 7/1997 | Li et al. | 437/4 |

OTHER PUBLICATIONS

Excerpt from Introduction to Manufacturing Processes; John A. Schey; McGraw-Hill; chapter 10, 1987.

*Primary Examiner*—Charles T. Jordan
*Assistant Examiner*—Christopher K. Montgomery
*Attorney, Agent, or Firm*—Harry A. Wolin; Ziye Zhou

[57] ABSTRACT

A method for forming a semiconductor fuse device (23) having a fuse element (20) for an igniter device, comprises the steps of providing a semiconductor substrate (12), forming an insulator layer (14) on the semiconductor substrate, forming a single active layer (16) on the insulator layer, having a predetermined depth (18) of greater than 4 microns and patterning and etching the active layer to form the fuse element (20). Preferably, the forming a single active layer step includes the step of atomic bonding an active layer to the insulator layer.

13 Claims, 4 Drawing Sheets

SEMICONDUCTOR FUSE DEVICE AND METHOD FOR FORMING A SEMICONDUCTOR FUSE DEVICE

FIELD OF THE INVENTION

This invention relates to a semiconductor fuse device for an igniter device and a method for forming a semiconductor fuse device for an igniter device.

BACKGROUND OF THE INVENTION

It is known to use igniters for igniting explosive materials in, for example, mining applications and also in blowing up air bags or retracting seat belts in automobiles for passenger safety.

Igniters typically comprise a fuse device having a fuse element which is located in proximity to the explosive material such that when the fuse element is energized, the explosive material is ignited. The fuse element may be a wire which passes through a cavity containing the explosive material and which is energized by passing a firing current through the wire. These wire fuses can however be unreliable due to their sensitivity to externally generated interference.

UK patent application no. GB-A-2190730 and U.S. Pat. No. US-A-4,708,060 disclose igniters having a semiconductor fuse device. Such semiconductor fuse devices generally comprise a fuse element positioned on a substrate between two contacts. External control circuitry is coupled to the two contacts via, for example, wire contacts and provides the firing current at the appropriate time which heats the fuse element and ignites the explosive material.

Typically, the fuse element is formed, for example, from a conductive metal layer formed on the substrate or from a polysilicon layer formed on an oxide layer, such as silicon dioxide, formed on the substrate or from a doped silicon layer formed on the substrate.

The operation of a semiconductor fuse device is dependent on the level of the firing current required to ignite the explosive material, the resistance of the fuse element, the level of the "no-fire" current and the ability of the device to withstand electrostatic discharge (ESD) and electromagnetic interference (EMI).

In certain applications, such as, for example, in seat belt retractors, there is an ongoing need to reduce the power consumption due to the firing current in the known semiconductor fuse devices. There is also a need to meet certain enhanced safety standards, such as the IEC801-2 standard.

SUMMARY OF THE INVENTION

In accordance with the present invention there is provided a method for forming a semiconductor fuse device having a fuse element for an igniter device the method comprising the steps of:

providing a semiconductor substrate;

forming an insulator layer on the semiconductor substrate;

forming a single active layer on the insulator layer, the acting layer having a predetermined depth greater than 4 microns; and patterning and etching the active layer to form the fuse element.

The method in accordance with the present invention thus provides an active layer that is sufficiently deep to ensure that the firing current is reduced, whilst not degrading the ESD and EMI response of the device nor varying the fuse resistance. An advantage of the invention is that it avoids the need for additional process steps as required by the prior art multilayered structures.

In a preferred embodiment, the step of forming a single active layer on the insulator layer comprises the step of atomic bonding an active layer to the insulator layer.

The forming an active layer step may include an additional step of patterning and etching at least one trench in a surface of the active layer before the step of atomic bonding the surface of the active layer to the insulator layer.

In an alternative embodiment, the steps of forming an insulator layer and a single active layer on the insulator layer comprise the step of bombarding the substrate with high energy oxygen so as to form an oxide insulator layer between two portions of the substrate, the active layer being formed by one of the two portions of the substrate.

Preferably, the predetermined depth of the active layer is 10 microns.

Circuitry for controlling the operation of the semiconductor fuse device may be integrated into the active layer by forming isolation trenches in the active layer to provide an active device region isolated from the fuse element and integrating the circuitry into the active device region.

A semiconductor fuse device and a semiconductor igniter device comprising a semiconductor fuse device with integrated circuitry are also disclosed and claimed.

BRIEF DESCRIPTION OF THE DRAWINGS

Exemplary embodiments of the present invention will now be described with reference to the accompanying drawings in which.

DETAILED DESCRIPTION OF THE DRAWINGS

Figure 1:
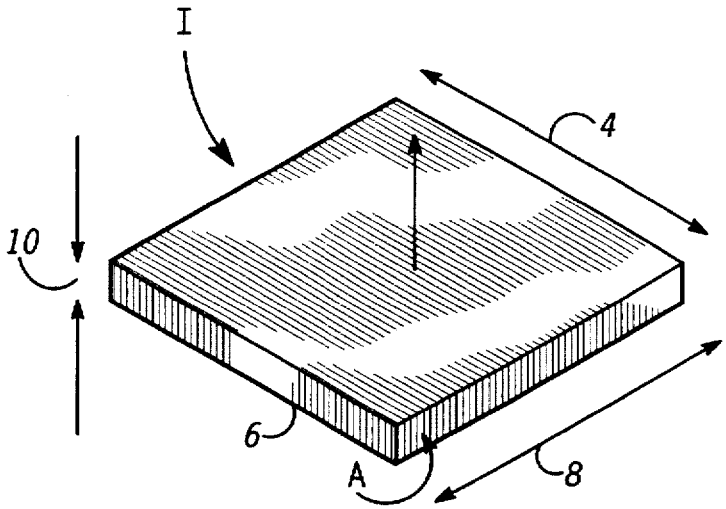
FIG. 1 shows a schematic representation of a semiconductor fuse element.
Figure 2:
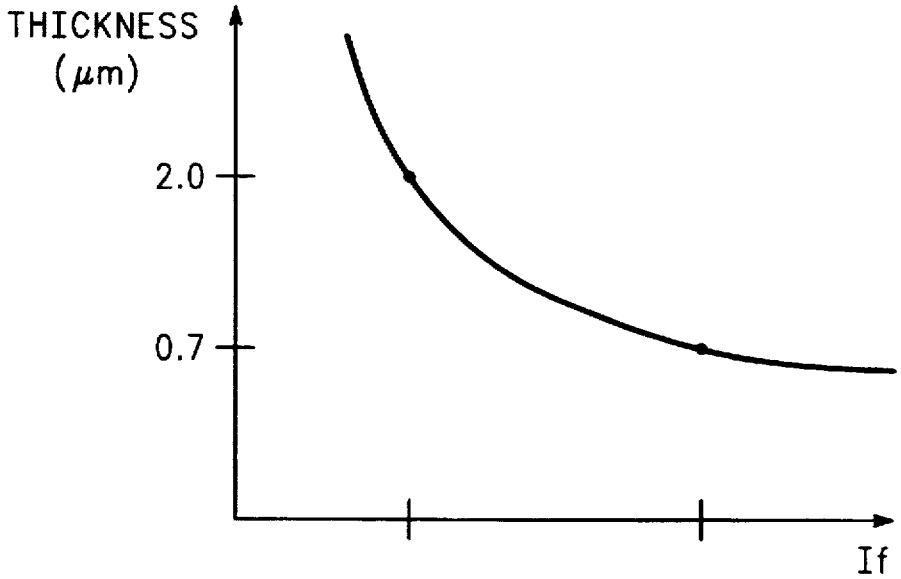
FIG. 2 shows the relationship between the firing current and the thickness of the firing element for a given resistance value.

As mentioned briefly above, the main operating parameters of a semiconductor fuse device include the level of the firing current (If), the ability to withstand ESD and EMI, and fuse resistance. With reference to the schematic representation of a semiconductor fuse element shown in FIG. 1, ESD is a function of the width 4 of the fuse element, the resistance is a function of cross-sectional area A and width 4 and the level of the firing current is an inverse function (see FIG. 2) of the area 6 of the fuse element which is in contact with the explosive material (not shown).

In view of the interrelationships between these three parameters, the inventors have realized that a reduction in power consumption can be obtained, whilst maintaining the same resistance value and not degrading the ESD, by increasing the depth 10 and reducing the length 8 of the fuse element.

With the known semiconductor fuse devices which have fuse elements formed from metal, polysilicon, doped silicon, the depths of these layers are not greater than a few microns. Due to process constraints, there are significant problems in increasing the depth 10 of the fuse element.

For example, with respect to polysilicon, due to mechanical stress induced in the layer, it is not possible to fabricate a single polysilicon layer having a depth greater than 1 micron. Thus, in order to increase the depth beyond 1 micron, it is necessary to use more than one polysilicon layer. However, after each polysilicon layer is formed it is necessary to perform an anneal in order to avoid mechanical stress in the layered structure. Since additional processing steps are required, such a layered structure is therefore difficult and expensive to manufacture.

The present invention provides the required ESD standard, reduced level of firing current and maintained fuse resistance without the above mentioned disadvantages.

A first method for forming a semiconductor fuse device in accordance with a first embodiment of the present invention will now be described with reference to FIGS. 3 to 6. The first embodiment uses the technique of atomic or wafer bonding.

Figure 3:
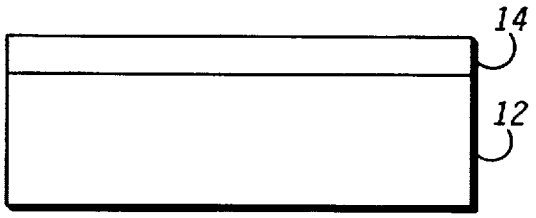
FIGS. 3–5 show simplified schematic cross-sectional views of a semiconductor fuse device, during different stages of fabrication, and formed by a first method in accordance with the present invention.

A substrate 12 is provided and an insulator layer 14 is formed on the substrate (FIG. 3). The insulator layer 14 may be formed of any material which provides a barrier to the transfer of heat, such as an oxide layer or nitride layer. In the preferred embodiment, a silicon dioxide layer is formed on a silicon wafer having a minimum depth of 0.5 microns.

Figure 4:
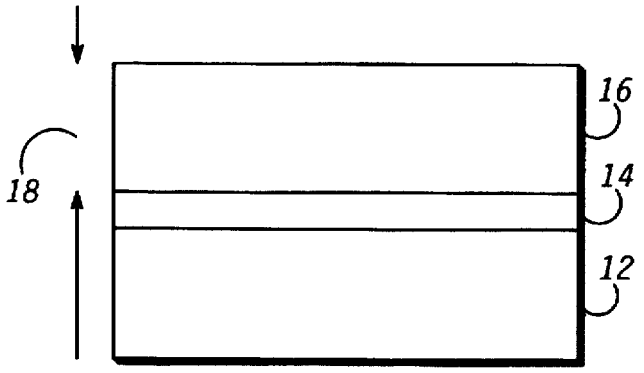

An active layer 16 is then atomically bonded to the insulator layer 14 (FIG. 4). Atomic bonding processes are well known in the art. The following method is an example of how the active layer 16 can be atomically bonded to the insulator layer 14.

In order to bond the active layer 16 to the insulator layer 14 and substrate 12, the insulator layer 14 and active layer 16 are cleaned with the following sequence: firstly, organic removal, followed by native oxide etching in diluted hydrofluoric acid solution (HF), then a water rinse and finally drying in warm nitrogen. The two hydrophobic surfaces of the insulator layer 14 and active layer 16 are immediately contacted together in a class 10 clean room with a flats misorientation between ±2°. If desired, two layers 14, 16 of different orientations can be bonded together. While the two layers 14, 16 are in contact at room temperature, the two layers are pre-strained in order to make the contact begin at the center of the layers so as to avoid voids during a following heat treatment step. The value of the strain should be controlled and not too high. The heat treatment step is performed in nitrogen ambient at 1200° C. for approximately 50 minutes in order to bond the layers.

Once the active layer 16 has been bonded to the insulator layer 14, the exposed surface of the active layer 16 is ground to the required or predetermined depth 18. The surface is then polished.

After grinding and polishing, the depth of the active layer 16 is greater than 4 microns. Preferably, it is within the range of 10 to 15 microns. However, the preferred depth is 10 microns since this meets the requirements of reduced firing current, maintained fuse resistance and ESD whilst providing good reproducibility.

Figure 5:
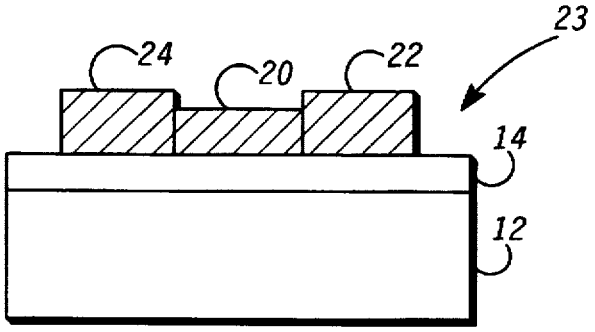
Figure 6:
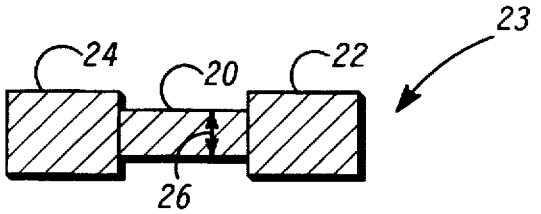
FIG. 6 shows a simplified schematic plan view of the semiconductor fuse device shown in FIG. 5.

The active layer 16 is then patterned and etched to form the fuse element 20 having a predetermined depth 18 and length 26. Contacts 22 and 24 are formed in conventional manner. FIGS. 5 and 6 show the semiconductor fuse device 23.

As is well known, when an appropriate voltage is provided between the two contacts 22 and 24, the potential difference across the fuse element 20 causes firing current to flow through the fuse element 20, which vaporizes and ignites the explosive material (not shown) that is compacted around the fuse element 20.

The active layer 16 may be formed from any conductive material which forms atomic bonds with the insulator layer 14. In a preferred embodiment, a silicon active layer 16 is bonded to a silicon dioxide insulator layer 14. The active layer 16 may also be silicon doped with arsenic, phosphorus, antimony, or the like.

The substrate and active layer can be formed of a material having any conductivity type, that is, N+, N−, P+, P−.

Figure 7:
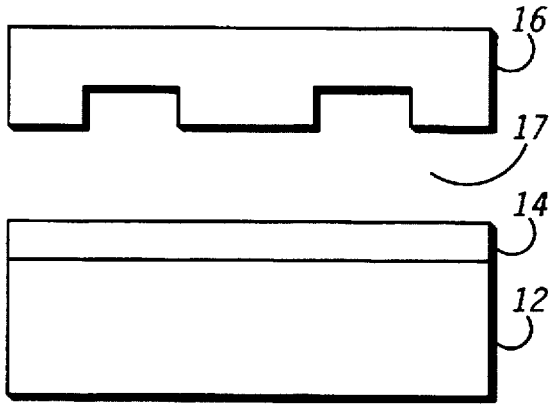
FIGS. 7–8 show simplified schematic cross-sectional views of the semiconductor fuse device during optional steps of the first method in accordance with the present invention.
Figure 8:
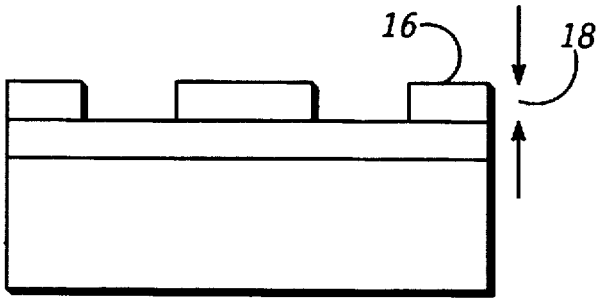

The above described method in accordance with the present invention may include an additional step of patterning and etching at least one trench 17 in the surface of the active layer 16 before bonding the surface to the insulator layer 14 (see FIG. 7). As described above, after bonding the active layer 16 is then ground and polished to achieve the desired depth 18 of active layer 16 (see FIG. 8).

Figure 9:
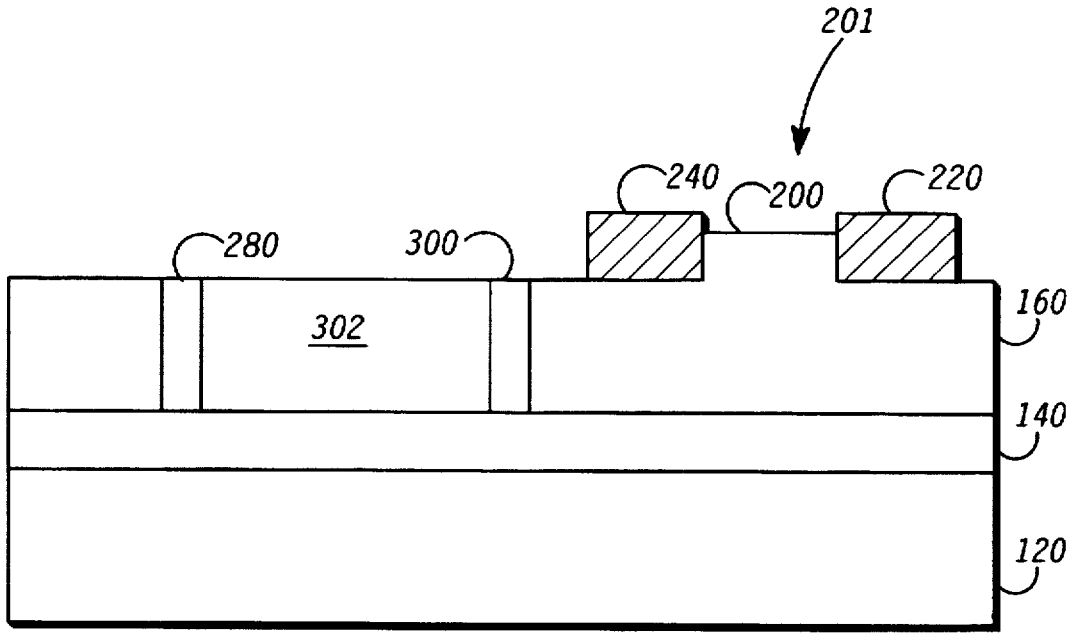
FIG. 9 shows a simplified schematic cross-sectional view of a semiconductor fuse device in accordance with the present invention wherein an active device region is formed for circuitry to be integrated therein.

The method in accordance with the first embodiment of the present invention can be used to form an igniter device arrangement shown in FIG. 9. Like components are referred to by the same reference numeral multiplied by 10.

Figure 10:
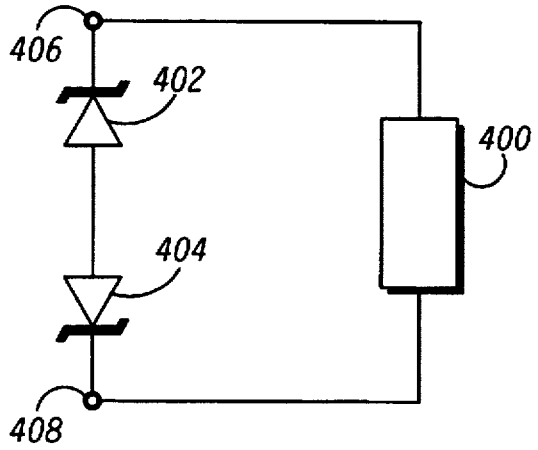
FIG. 10 shows a simplified schematic circuit diagram of circuitry which may be integrated in the active device region shown in FIG. 9.

Since the depth of the active layer 160 is at the minimum of 4 microns, he active layer can be patterned and etched as shown in FIG. 9 to form the fuse element 200. Isolation trenches 280 and 300 can then be formed in the active layer 16 so as to provide an active device region 302 isolated from the semiconductor fuse device 201 such that circuitry can be integrated into the active device region 302. The circuitry may include zener diodes, such as the two back-to-back zener diodes 402 and 404 shown in FIG. 10, to provide enhanced ESD protection. The two zener diodes 402 and 404 are coupled across the semiconductor fuse element 400 between two contacts 406 and 408. The circuitry may also include more complex combinations of active elements to control the operation of the semiconductor fuse device. Such an arrangement would avoid the need for external circuitry.

The present invention has so far been described with reference to atomic or wafer bonding an active layer to an insulator layer on a substrate so as to provide an active layer having a depth greater than 4 microns. It is not intended that the invention be limited to atomic bonding only. Other methods such as high energy oxygen implant may be used.

Figure 11:
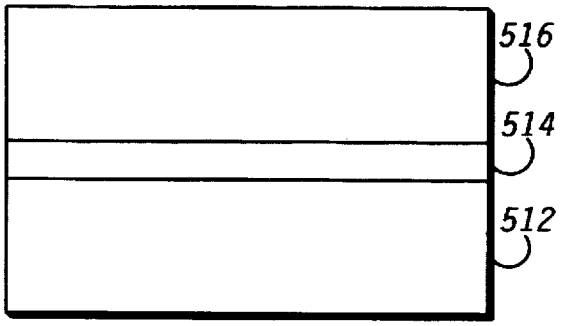
FIG. 11 shows a simplified schematic cross-sectional view of a semiconductor fuse device formed by a second method in accordance with the present invention.

With a high energy oxygen implant method, a substrate 512, such as a silicon substrate, is bombarded with high energy oxygen such that the oxygen migrates through the substrate to form an oxide insulator layer 514 as shown in FIG. 11. Circuitry may be integrated into the active layer 516 as described above.

Thus, a method for forming a semiconductor fuse device in accordance with the present invention provides an active layer that is sufficiently deep to ensure that the firing current is reduced, the ESD is not degraded and the fuse resistance is not varied, but without the need for multi-layer structures and their associated additional process steps as required by the prior art processes. A further advantage of the method in accordance with the present invention is that it allows integration of simple or complex functions. The single active layer having a depth greater than 4 microns means that circuitry, such as zener diodes to enhance ESD protection and more complex control circuitry to control the operation of the semiconductor fuse device can be integrated into the active layer. Moreover, since the substrate and active layer can be formed of a material having any conductivity type, that is, N+, N−, P+, P−, the present invention allows greater flexibility for integrating functions with the semiconductor fuse device.

We claim:

1. A method for forming a semiconductor fuse device having a fuse element for an igniter device, the method comprising the steps of:

providing a semiconductor substrate;

forming an insulator layer on the semiconductor substrate;

atomically bonding a single active layer to the insulator layer;

grinding and polishing the single active layer to a predetermined depth greater than 4 microns; and patterning and etching the single active layer to form the fuse element.

2. A method according to claim 1 wherein the atomically bonding step includes the steps of:

patterning and etching at least one trench in a surface of the single active layer; and atomically bonding the surface of the single active layer to the insulator layer.

3. A method according to claim 1 wherein the predetermined depth of the single active layer is 10 microns.

4. A method according to claim 1 wherein the insulator layer has a depth of at least 0.5 microns.

5. A method according to claim 1 wherein the semiconductor substrate is formed from silicon material and the insulator layer is formed from silicon dioxide material.

6. A method according to claim 1 wherein the single active layer is formed from a material selected from the group consisting of silicon, arsenic, phosphorus and antimony.

7. A method for forming a semiconductor igniter device comprising a semiconductor fuse device and circuitry for controlling the operation of the semiconductor fuse device, the method comprising the steps of:

forming the semiconductor fuse device having a fuse element by at least the steps of:

providing a semiconductor substrate, forming an insulator layer on the semiconductor substrate, forming a single active layer on the insulator layer, the single active layer having a predetermined depth of greater than 4 microns, and patterning and etching the single active layer to form the fuse element;

forming isolation trenches in the active layer to provide an active device region isolated from the semiconductor fuse device; and integrating the circuitry into the active device region.

8. A method according to claim 7 wherein the forming a single active layer step includes the step of atomically bonding the single active layer to the insulator layer.

9. A method according to claim 8 wherein the step of forming a single active layer further comprises the step of grinding and polishing the single active layer formed on the insulator layer so that the active layer has the predetermined depth.

10. A method according to claim 7 wherein the forming a single active layer step includes the steps of:

providing an active layer;

patterning and etching at least one trench in a surface of the active layer; and atomically bonding the surface of the active layer to the insulator layer to form the single active layer.

11. A method according to claim 10 wherein the step of forming a single active layer further comprises the step of grinding and polishing the single active layer formed on the insulator layer so that the active layer has the predetermined depth.

12. A method according to claim 7 wherein the steps of forming an insulator layer and a single active layer on the insulator layer comprise the step of bombarding the semiconductor substrate with high energy oxygen so as to form an oxide insulator layer between two portions of the semiconductor substrate, the single active layer being formed from one of the two portions of the semiconductor substrate.

13. A semiconductor igniter device comprising:

a semiconductor fuse device having a fuse element and comprising:

a semiconductor substrate, a single active layer patterned and etched to form the fuse element, the single active layer having a predetermined depth greater than 4 microns, and an insulator layer between the semiconductor substrate and the fuse element;

isolation trenches formed in the active layer to provide an active device region isolated from the semiconductor fuse device; and circuitry integrated into the active device region for controlling the operation of the semiconductor fuse device.

* * * * *